United States Patent [19]

Holder

[11] Patent Number: 4,981,099

[45] Date of Patent: Jan. 1, 1991

[54] WATERCRAFT

[76] Inventor: Ron Holder, 25051 Monte Verde, Laguna Niguel, Calif. 92677

[21] Appl. No.: 324,690

[22] Filed: Mar. 17, 1988

[51] Int. Cl.[5] ..... B63B 1/24

[52] U.S. Cl. ..... 114/274; 114/123

[58] Field of Search ..... 114/61, 56, 274, 59, 114/272, 278, 283, 292

[56] References Cited

U.S. PATENT DOCUMENTS

| | | | |
|---|---|---|---|
| 3,897,744 | 8/1975 | Lang | 114/61 |
| 4,449,472 | 5/1984 | Meyer, Jr. | 114/274 |
| 4,582,011 | 4/1986 | Logan | 114/61 |

*Primary Examiner*—Joseph F. Peters, Jr.
*Assistant Examiner*—Jesûs D. Sotelo
*Attorney, Agent, or Firm*—Charles C. Logan, II

[57] ABSTRACT

The improved watercraft comprises an underwater pod or pods, that support a pecentage of the displacement of the watercraft at rest. The percentage of displacement produced by the pods could vary widely based upon the purposes of the watercraft and its intended range of uses, i.e., speed, water conditions, cargo, length, etc. The improved watercraft is also comprised of one or more hulls at the surface, which when at rest, displace most of the remainder of the watercraft's total weight. The rest of the watercraft's displacement, normally a small percentage, is comprised of hydrofoils, or wings, and these provide lift for the watercraft when under way. These hydrofoils or wings would normally be designed to be sufficient in area and dynamic lift to raise the surface hull clear of the water's effects, if that was desirable for the intended purpose.

4 Claims, 5 Drawing Sheets

WATERCRAFT

BACKGROUND OF THE INVENTION

The invention relates to watercraft, and more specifically to the area of foil borne, or hydrofoil watercraft. Applicant's invention is applicable to wind, engine, motor or human powered watercraft.

Hydrofoil watercraft (Hydrofoils) have been constantly improved over the years, but still many unresolved problems. They tend to require a great deal of power to overcome the low speed drag caused by the entire displaced portion of the watercraft's hull plus the additional drag introduced by the foils themselves. Hydrofoils do have less hydrodynamic drag than conventional watercraft when foil borne, but have generally poor handling characteristics when in choppy or rough seas. The invention of Patrick Leehey, U.S. Pat. No. 2,926,623, assists in overcoming these performance characteristics in rough water at the expense of additional low speed drag.

When a Hydrofoil is foil borne, 100% of the displacement of the watercraft is carried by the foils. If the flow of water is interrupted over one or more of the foils by either, sea conditions or detached flow due to stalling or ventilation, the entire Hydrofoil is susceptible to crashing. This is a common occurence with Hydrofoils and can be disasterous.

Other types of watercraft have been introduced attempting to acheive low drag or smooth operation in rough water, i.e. the S.W.A.T.H. type, but these are generally greater in wetted surface area than conventional watercraft and suffer from excessive power requirements as well.

All watercraft are governed by frictional and wavemaking resistances at, above and below the air/water interface. A typical surface traveling watercraft hull is limited in top speed by wavemaking resistance in proportion to its length by an approximation of Froude's number. Frictional resistance is, primarily, a function of Reynold's number.

Submarines are considered differently, however, in that they are acting theoretically as a body in an incompressible fluid. Gravity force does not affect the flow around the fluid particles, therefore, wavemaking resistance underwater is significantly less than at the surface. Submarines have limited usefulness, though.

It is an object of the invention to overcome some or all of the disadvantages of Hydrofoil watercraft mentioned above.

It is another object of the invention to provide a watercraft for a full range of efficient speeds from slow to extremely fast, improving economy, smoothness of ride, safety and other handling characteristics.

Additional objects of the invention will in part become evident, hereafter.

SUMMARY OF THE INVENTION

Applicant's watercraft comprises an underwater pod, or pods, (POD) that support a percentage of the displacement of the watercraft at rest. The POD could vary widely in percentage of displacement based on the purpose of the watercraft and its intended range of uses, i.e., speed, water conditions, cargo, length, etc. It is most likely to be, but not limited to, between 25% and 75–85% of the total displacement of the watercraft.

Applicant's watercraft is also comprised of one or more hulls at the surface, (SURFACE HULL), when at rest, which displace most of the remainder of the watercraft's total weight.

The rest of the watercraft's displacement, normally a small percentage, is comprised of Hydrofoils, or wings, (FOILS). These FOILS also provide a lift for the watercraft when under way. The FOILS would normally be designed to be sufficient in area and dynamic lift to raise the SURFACE HULL clear of the water's effects, if that was desirable for the intended purpose.

For engine powered and human powered watercraft, the FOILS would be oriented to provide stability, performance and safety. On a sailing watercraft, the FOILS, would be designed to additionally provide stability and resistance against the forces generated by the sails.

The elements of applicant's improved watercraft described herein are subject to wide and varying design, based on the ultimate use of the watercraft. It is therefore the intention here to be illustrative and disclosing the invention by example, but not be limited by the description.

The watercraft normally operates as follows:

The POD is submerged at rest, as are most or all of the FOILS. The SURFACE HULL is supporting the balance of the displacement of the watercraft. As the watercraft accelerates, the FOILS begin to take a portion of the SURFACE HULL displacement in the form of dynamic lift. This reduces the SURFACE HULL's wetted area and wave making drag. Normally, the watercraft would be designed to have this effect continue as speed increases until the entire SURFACE HULL is clear of the water's surface.

There are several modes of operation. Buoyant mode, where the FOILS provide no significant dynamic lift. Semi-buoyant mode, where the FOILS provide some lift, but not enough to clear the SURFACE HULL free of the water's surface. The flying mode, for most designs, is when the FOILS' lift has entirely displaced the SURFACE HULL's buoyancy.

The POD generally remains submerged at all times, during operation, to maintain the lowest possible drag, as total underwater drag is lower than the total drag at the surface. This does not preclude the possibility, however, of retracting the POD for operation in shallow water or the light loaded condition.

Due to the displacement from the POD of a percentage of the watercraft's overall weight, the FOILS are more lightly loaded than in a common Hydrofoil. This allows the FOIL to be a less significant portion of the overall or total displacement, thus reducing the criticalness of the FOILS successful operation. If, for instance the FOILS ventilate or stall, the watercraft is less prone to crash as the FOILS involved are not supporting the entire weight of the watercraft. The POD also has considerable more length than the foil it is replacing from a Hydrofoil craft. When under way, the flow of water over the POD gives the watercraft increased directional stability not offered by Hydrofoil watercraft. This would also permit the POD to be of a design to provide additional lift of their own, as in lifting body airplane designs, or even a flying wing type, where the distinction between FOILS and POD is difficult to make.

Many beneficial effects can be derived from the operation of applicant's design. Some of these are described below.

At low speeds, in the buoyant mode, the low wetted area allows efficient use of the power available to drive the watercraft.

When in the semi-buoyant mode, the FOIL is reducing the load on the SURFACE HULL, reducing wetted area and wave making resistances. This transferance also reduces the water's surface conditions effect on the watercraft' trim. For some designs, this may be the totality of their designed modes. It is most likely, though, for the watercraft to be designed for the next mode, "flying".

When in the flying mode, the SURFACE HULL is free of the water's surface and causes little drag, mostly aerodynamic. Yet, it is there if needed to assist the FOILS and POD as reserve buoyancy. The FOILS are efficiently carrying their percentage of the watercrafts' displacement, the total drag being less if the SURFACE HULLS were displacing all the load.

Possible additional elements for most of the designs utilizing the invention are sensing and controlling devices for the watercraft's six principal degrees of freedom: surge, sidesway, heave, roll, pitch and yaw. These optional devices would control the watercraft's attitude, altitude and direction. These devices may control one or more of the inventions FOILS and provide control, safety, performance, or all of these.

On a sail driven design of the invention, these may also include for example, center boards, retractable or not, keels, stabilizers and/or other FOILS and controls for managing the effects of the sail plan.

For any of the designs of the invention, these additional elements may be manually, mechanically, automatically, electrically, electronically, computer, remotely or otherwise controlled to initiate, maintain, induce, or force control upon the invention.

A rudder is, obviously, one of the sample optional elements. This may not be necessary, however, for watercraft of the invention of "sailboard" types, or for watercraft of the invention with turning power sources, i.e., outboard driven, inboard/outboard driven, turning-jet driven, etc.

Another sample optional element could be gyroscopically, manual or computer controlled foil stabilizer devices.

DESCRIPTION OF THE PREFERRED EMBODIMENT

Applicant's novel improved watercraft will not be described by referring to FIGS. 1–16 of the drawings. The watercraft is known as a foil-assisted subaqueous transport (F.A.S.T.).

Figure 1:
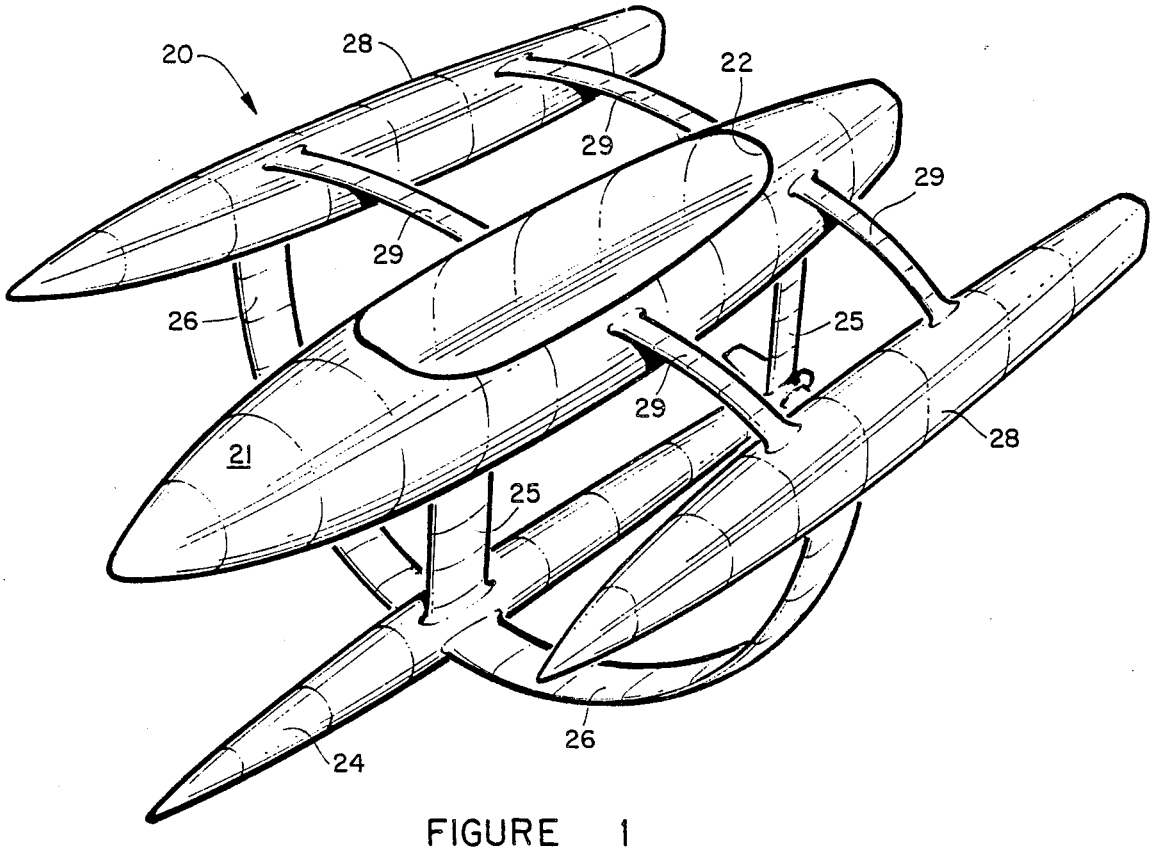
FIGS. 1–3 illustrate a first version of the applicant's novel improved watercraft.
Figure 2:
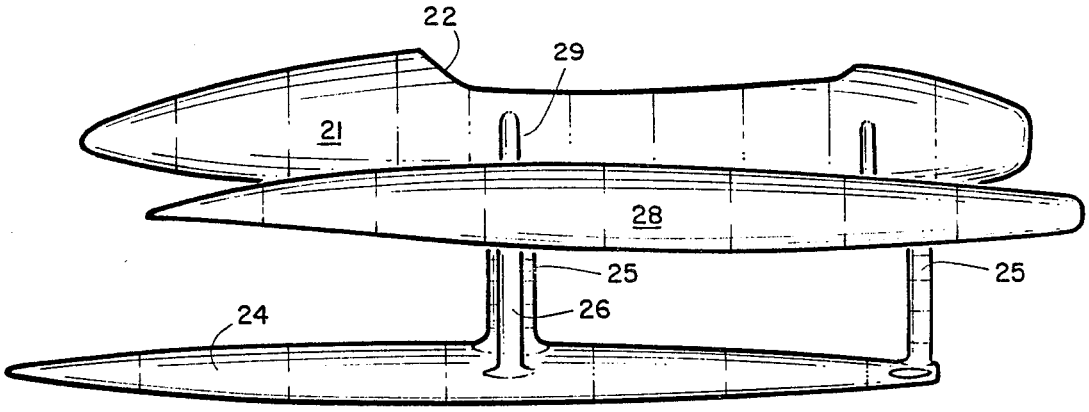
Figure 3:
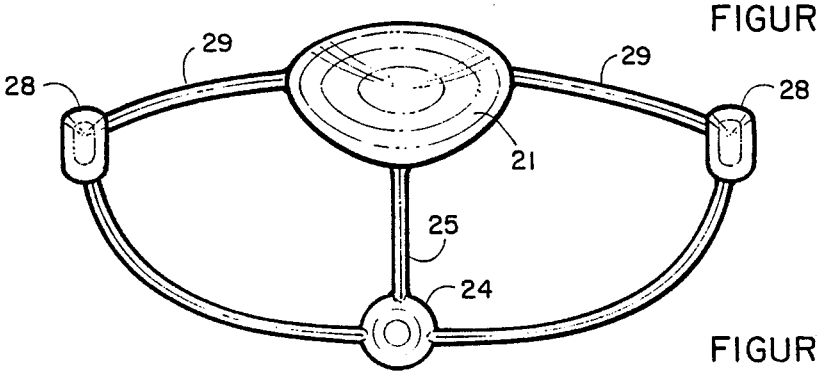
Figure 4:
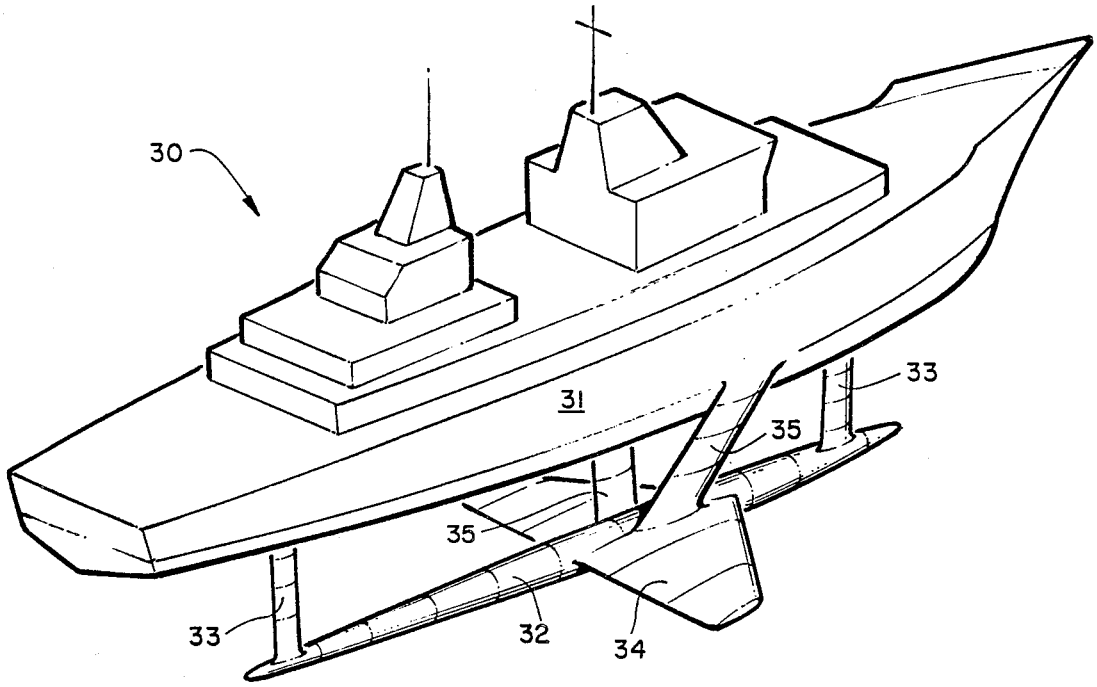
FIG. 4 illustrates a second version of applicant's watercraft in the form of a high speed naval ship.

The first version of the F.A.S.T. watercraft is illustrated in FIGS. 1–3 and it is generally designated numeral 20. It has a hull 21 having a cockpit 22 for one or two persons. An underwater pod 24 is supported a predetermined distance below hull 21 by a pair of support struts 25, one of which could be a rudder. Foil-shaped struts 26 extend outwardly and upwardly from underwater pod 24 and have their top ends connected to floatation members 28. Foil-shaped connecting members 29 secure the flotation members 28 to the hull 21.

In FIG. 4*a* second version of the F.A.S.T. watercraft is illustrated and it is designated numeral 30. This version has a monohull 31 such as would be used with a high speed navalship. An underwater pod 32 is supported a predetermined distance below hull 31 by support struts 33. A pair of foil-shaped struts 35 have their bottom ends attached to underwater pod 32 and their top ends secured to hull 31.

Figure 5:
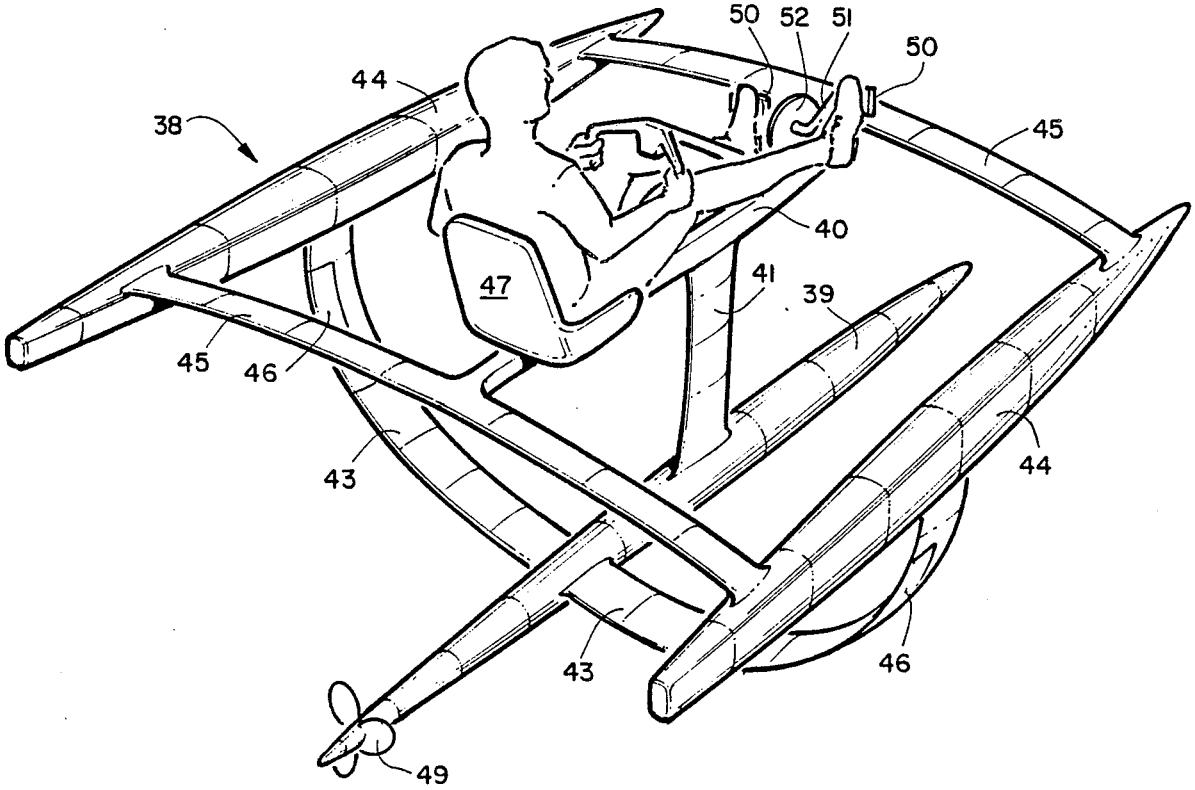
FIG. 5 illustrates applicant's novel watercraft in the form of a self-powered recreational boat.

The version of the F.A.S.T. watercraft illustrated in FIG. 5 shows a light self-powered recreational boat that is generally designated numeral 38. It has an underwater pod 39 that is supported a predetermined height below seat support member 40 by support struts 41. A pair of foil-shaped struts 43 connect underwater pod 39 with floatation members 44. Foil-shaped connecting members 45 provide a rigid connecting structure between the respective floatation members 44 and provide a supporting structure for seat support member 40. A seat 47 is mounted on seat support member 40 and the driver has steering handles 48. The propulsion power for the watercraft is provided by a propeller 49 driven by conventional gears or chains and sprockets that are actuated by pedals 50 on crank arms 51 extending from sprocket gear 52.

Figure 6:
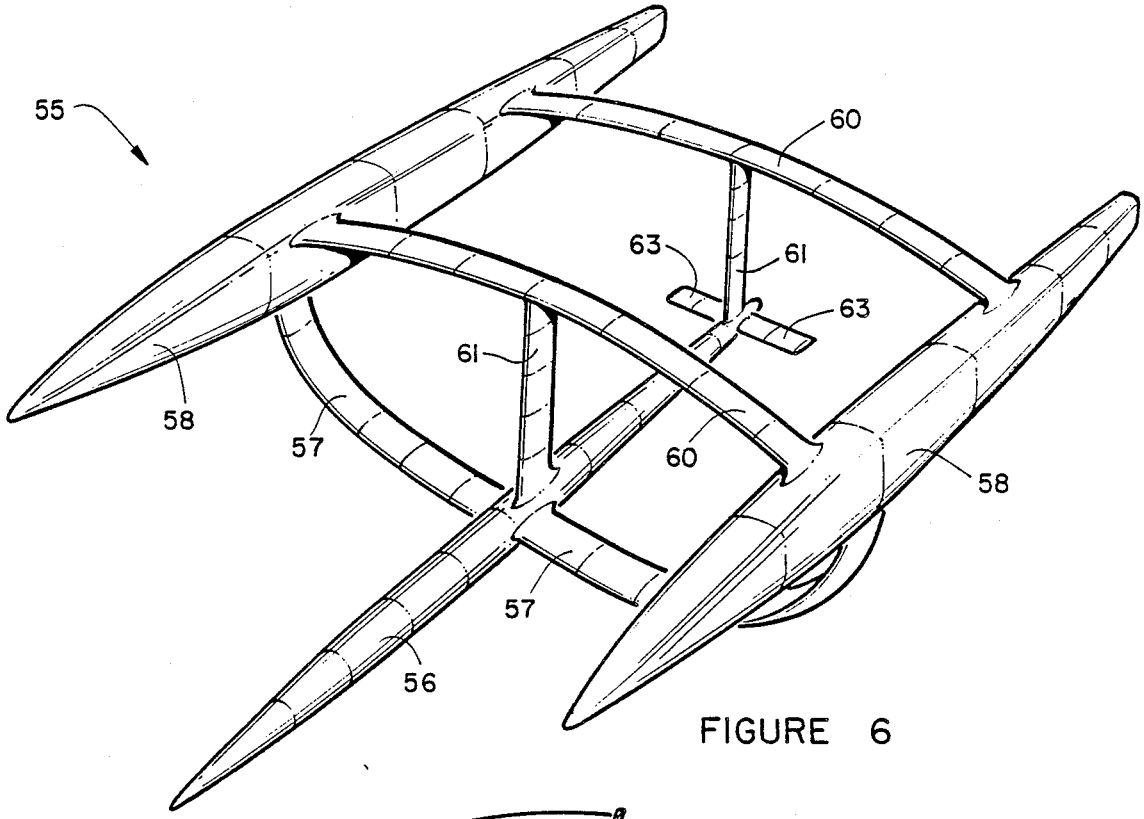
FIG. 6 illustrates a fourth version of applicant's watercraft such as would be used for the base of catamaran.

The version of the F.A.S.T. watercraft illustrated in FIG. 6 relates to watercraft such as catamarans. Only the portion that sits in the water is illustrated and it is generally designated numeral 55. It has an underwater pod 56 having foil-shaped struts 57 connected to floatation members 58. Foil-shaped connecting members 60 connect the respective floatation members. Support struts 61 have an hydrodynamic configuration and connect underwater pod 56 with the foil-shaped connecting members 60. Foil-shaped stabilizers 63 extend laterally from both sides of underwater pod 56. A trampoline-like support deck could be extended across the top of foil-shaped connecting members 60 to provide a support surface for the crew.

Figure 7:
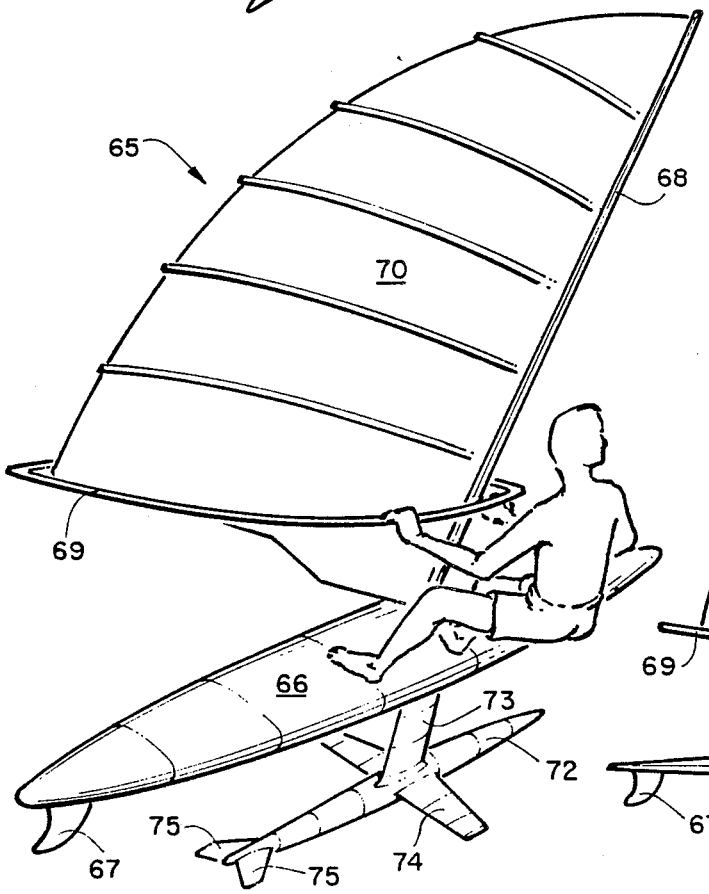
FIGS. 7 and 8 illustrate a fifth version of applicant's watercraft in the form of a sailboard.
Figure 8:
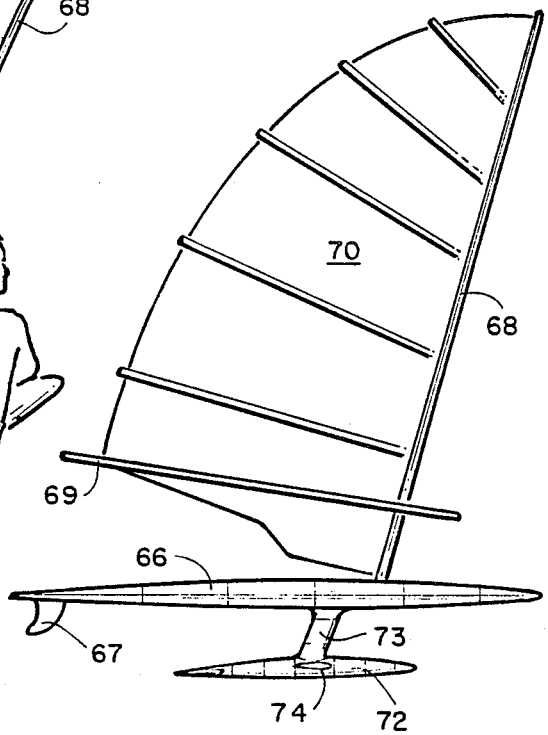

A windsurfing version of the F.A.S.T. watercraft is illustrated in FIGS. 7–8 and it is generally designated numeral 65. It has a sailboard hull 66 having a rear fin 67. A mast 68 extends upwardly from its top surface and supports a boom 69 and sail 70. Underwater pod 72 has its top surface connected to a support strut 73 that inserts into the dagger board slot and it would have structure which would allow it to be given an adjustable pitch. Foil shaped stabilizers 75 extend laterally from the rear end of underwater pod 72.

Figure 9:
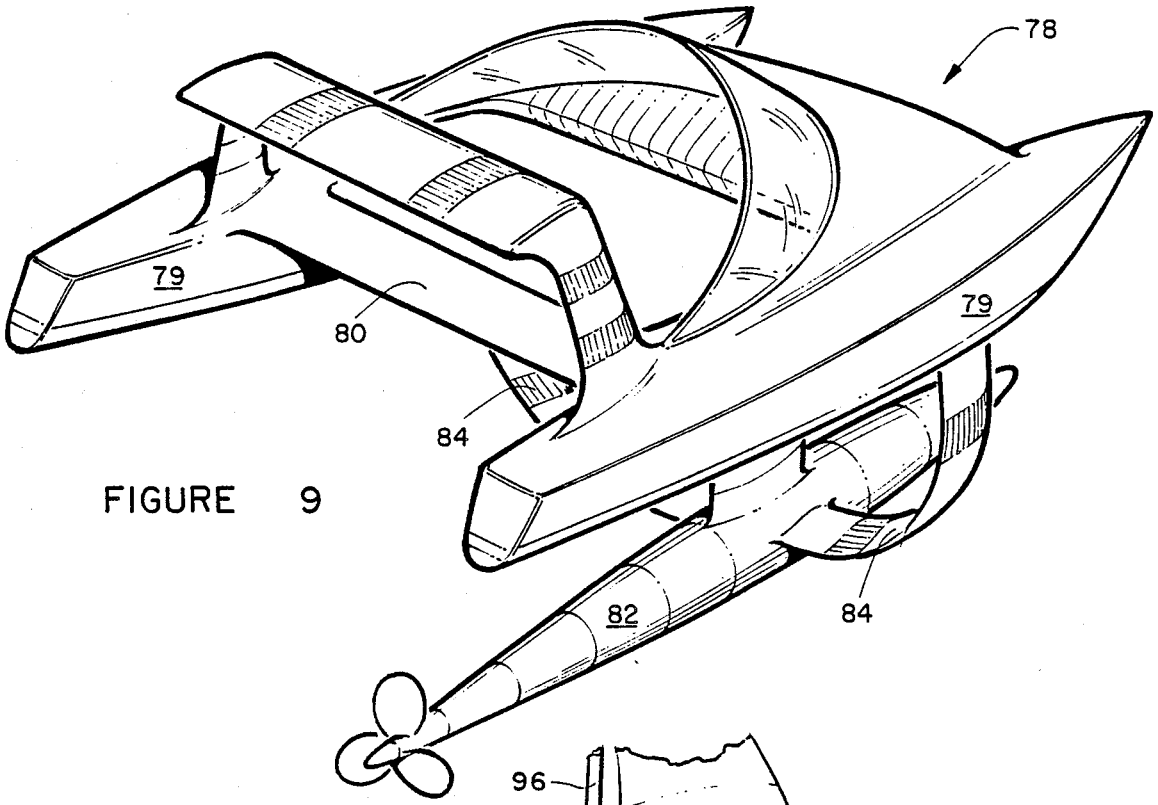
FIG. 9 illustrates a sixth version of applicant's watercraft in the form of a passenger carrier.

In FIG. 9, the version of applicant's F.A.S.T. watercraft is shown to relate to a yacht, passenger carrier, or naval vehicle type of sea vessel. It is generally designated numeral 78. And it has a pair of laterally spaced hulls 79 attached to each other by connecting structure 80 of the boat super structure. An underwater pod 82 is spaced a predetermined distance below the boat super structure by support strut 83. Foil-shaped struts 84 connect underwater pod 82 to the respective hulls 79.

Figure 10:
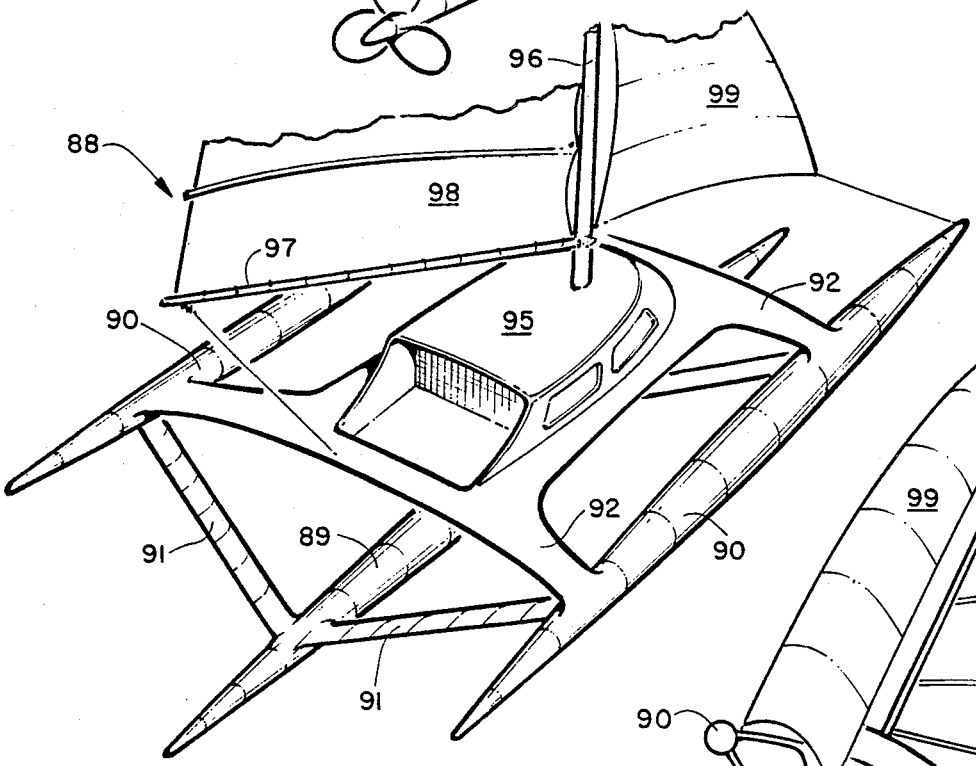
FIGS. 10–11 illustrate applicant's watercraft in the form of a sailboat.
Figure 11:
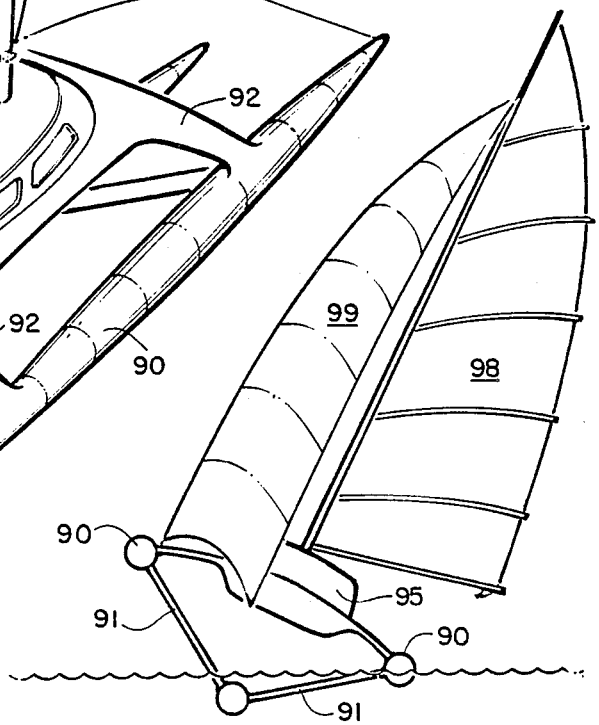

In FIGS. 10 and 11, the F.A.S.T. watercraft illustrated relates to sailboats and is generally designated numeral 88. These watercraft have an underwater pod 89 that is connected to laterally spaced hulls 90 by foil shaped struts 91. Support members 93 connect the respective hulls 90 and also provide a support for the cabin structure 95. A mast 96 extends upwardly therefrom and supports a boom 97 and sails 98 and 99. The hulls 90 could be empty or filled with water ballast as weather demands for stability and power. During its sailing, the weather foil has its effectiveness decreased as it lifts out of the water (see FIG. 11) and the leeward foil develops lift and reduces displacement.

Figure 12:
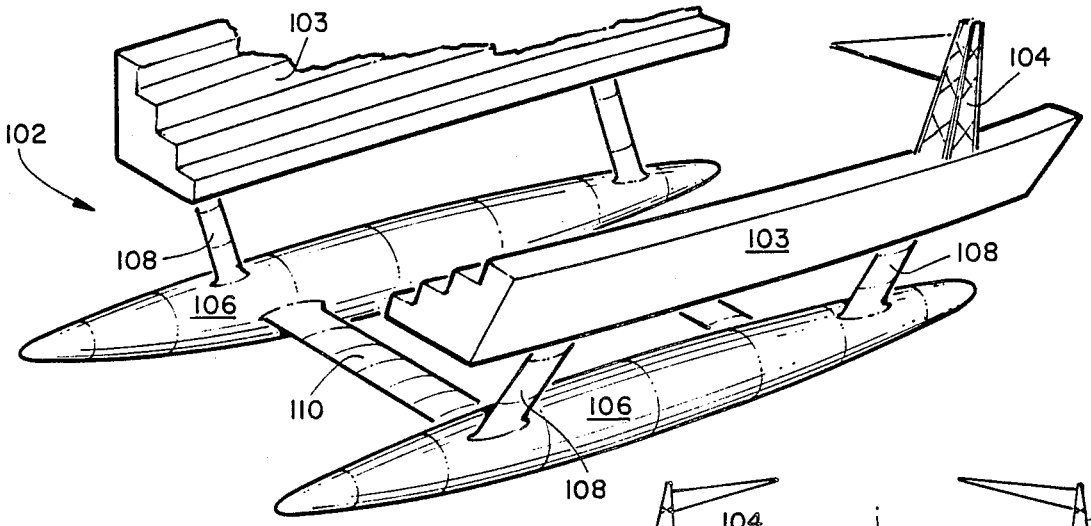
FIGS. 12 and 13 illustrate an eigth version of applicant's watercraft in the form of a self-propelled drydock.
Figure 13:
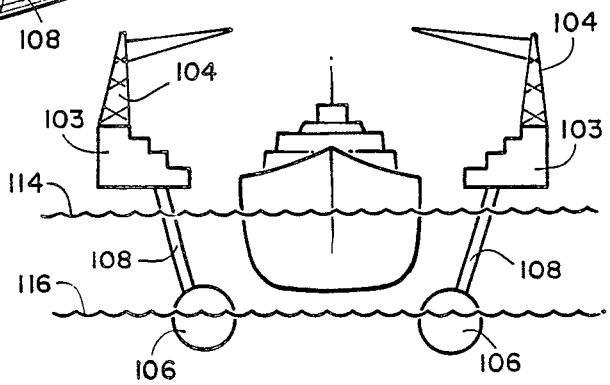

The F.A.S.T. version of the watercraft illustrated in FIGS. 12 and 13 relate to self propelled dry docks and it is generally designated numeral 102. It has a pair of laterally spaced hulls 103 having overhead cranes 104 mounted thereon. A pair of underwater pods 106 are spaced a predetermined distance below hulls 103 by foil-shaped struts 108. Underwater pods 106 are attached to each other by connecting members 110. In FIG. 13, the schematic illustration shows a ship 112 having an at rest water level 114 and a propelled or towed water level 116.

Figure 14:
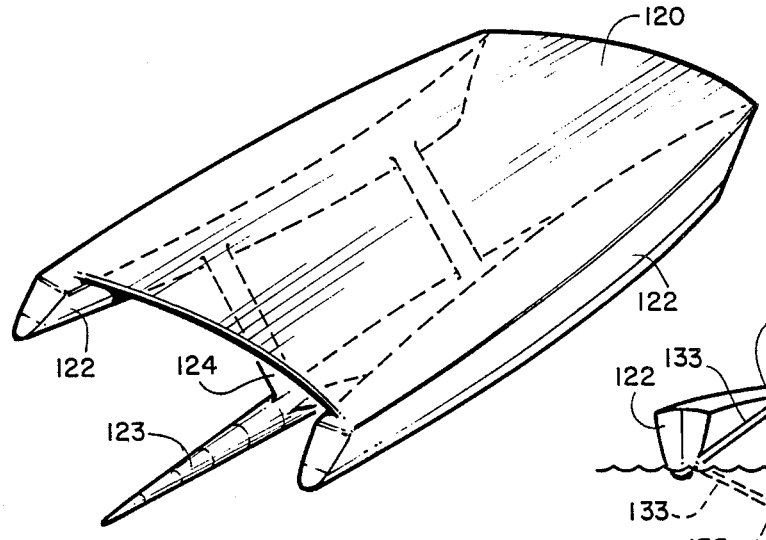
FIGS. 14–16 illustrate various underwater configurations for applicant's watercraft.
Figure 15:
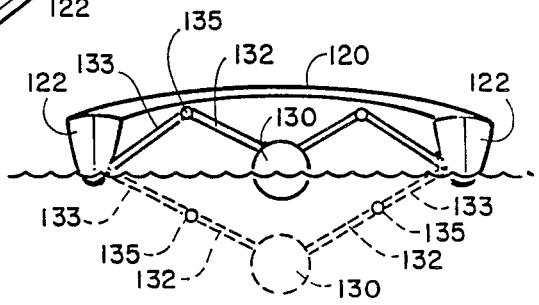
Figure 16:
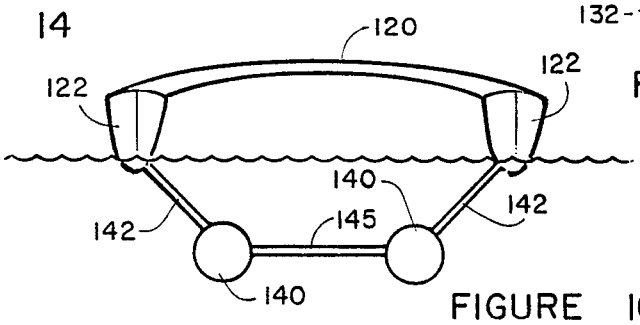

A variety of underwater configuration for the F.A.S.T. watercraft are shown in FIGS. 14–16. Each have a boat platform structure 120 that is supported on laterally spaced hulls 122. The version illustrated in FIG. 14 has an underwater pod 123 that is supported a predetermined distance below hulls 122 by foil-shaped struts 124 which have a rigid structure. In FIG. 15, the underwater pod 130 has foil-shaped struts 132 and 133 that are connected together by hinge assemblies 135 which allow the underwater pod 130 to be retracted up under boat platform structure 120 when in shallow water or when at anchor. The version illustrated in FIG. 16 has a pair of underwater pods 140 that are supported a predetermined distance below the respective hulls 122 by foil-shaped struts 142. The underwater pods 140 are attached to each other by a connecting member 145.

What is claimed is:

1. An improved watercraft comprising:

an elongated hull which has a predetermined displacement as a freestanding component floating on the water, said hull having a top surface, a bottom surface and laterally spaced side surfaces;

at least one elongated underwater pod located at a position in the water below the bottom surface of said hull, said pod having a water displacement volume sufficient to displace between 40% (25%) to 85% of the total displacement of said hull at rest;

support strut means rigidly connecting said hull to said underwater pod to produce a predetermined vertical spaced relationship between them;

a pair of elongated floatation members that are positioned so that one of them is on each lateral side of said elongated hull; and at least two foil shaped struts each having a first end and a second end, the first ends of said foil shaped struts being connected to said underwater pod, the respective second ends of said foil shaped struts being connected to a different one of said floating members.

2. An improved watercraft as recited in claim 1 further comprising at least two connecting members each having a first end and a second end, the respective first ends being connected to said elongated hull and said second ends each being connected to a different one of said floating members.

3. An improved watercraft comprising:

an elongated hull which has a predetermined displacement as a free standing component floating on the water, said hull having a top surface, a bottom surface and laterally spaced side surfaces;

at least one elongated underwater pod located at a position in the water below the bottom surface of said hull, said pod having a water displacement volume sufficient to displace between 25% to 85% of the total displacement of said hull;

strut support means rigidly connecting said hull to said underwater pod to produce a predetermined vertical spaced relationship between them; and at least two foil shaped struts each having a first end and a second end, the first ends of said foil shaped struts being connected to said underwater pod, the respective second ends of said foil shaped struts being connected to a different lateral side surface of said elongated hull.

4. An improved watercraft as recited in claim 3 wherein said foil shaped struts have a curved configuration in their lengthwise dimension.

* * * * *